United States Patent [19]

Maund

[11] 4,361,019

[45] Nov. 30, 1982

[54] DYEING YARNS

[76] Inventor: Roderick A. Maund, 54 Pemberton St., Botany, Sydney, N.S.W., Australia, 2019

[21] Appl. No.: 173,599

[22] Filed: Jul. 30, 1980

[51] Int. Cl.[3] ..... D06B 1/02

[52] U.S. Cl. ..... 68/62; 8/499; 68/205 R; 118/420

[58] Field of Search ..... 68/205 R, 207, 62; 8/499; 118/420

[56] References Cited

U.S. PATENT DOCUMENTS

| | | | |
|---|---|---|---|
| 266,481 | 10/1882 | Klauder | 8/502 |
| 3,899,903 | 8/1975 | Lapierre | 68/205 R |
| 3,974,534 | 8/1976 | Yelton et al. | 8/155.1 |
| 3,983,723 | 10/1976 | Ameling | 8/499 |
| 4,037,560 | 7/1977 | Lutz et al. | 68/205 R |
| 4,153,961 | 5/1979 | Cleveland | 68/205 R |

FOREIGN PATENT DOCUMENTS

| | | | |
|---|---|---|---|
| 2051899 | 1/1981 | United Kingdom | 68/205 R |

*Primary Examiner*—Michael R. Lusignan

*Attorney, Agent, or Firm*—Weingarten, Schurgin, Gagnebin & Hayes

[57] ABSTRACT

A method of dyeing yarns is provided wherein a single yarn or a web of parallel yarns is passed through a falling stream of liquid dyestuff which is substantially at boiling temperature when it contacts the yarn. The falling stream may be interrupted intermittently or may be traversed to and fro of the yarn to dye the yarn intermittently. Apparatus for conducting the method is described.

8 Claims, 2 Drawing Figures

DYEING YARNS

FIELD OF THE INVENTION

This invention relates to the dyeing of yarns and more particularly, but not exclusively, to the dyeing of yarns of synthetic fibres such as nylon, wool and the various polyester fibres.

BACKGROUND OF THE INVENTION

The traditional way of dyeing yarns has been to steep hanks of the yarn in vats of dyestuff to impregnate the yarn with the dyestuff and then remove the hanks from the vat and allow them to drain and dry.

However, yarns dyed by that traditional method usually exhibit undesirable variations in colour due to differing degress of take-up of the dyestuff by the yarn in different parts of the hank. This effect is particularly marked when using modern synthetic materials of the kind mentioned above.

Thus, it has now become customary to spray or print the dyestuff on to a moving strand, a web of parallel strands or a knitted or woven sheet of the yarn (which sheet may subsequently be unravelled) to ensure an even application of the dyestuff to the yarn.

Hitherto, it has been thought necessary for such printing or spraying to be carried out utilising liquid dyestuffs at room temperature, following which, the yarn is steam or otherwise heated to set the dye. Thus, to obtain even colouration, a relatively complex two step process is currently used involving relatively complex apparatus including a steam-heating chamber, oven or the like.

An object of the present invention is to simplify the abovementioned presently used process.

SUMMARY OF THE INVENTION

According to the invention, the yarn, either as a single yarn or as a web of substantially parallel yarns, is passed through a falling stream, which term includes a spray, shower or sheet, of liquid dyestuff as before, but the dyestuff is brought to the boil immediately prior to its application to the strand so that it is substantially at boiling temperature when it contacts the yarn. It has been found that this eliminates the need for a subsequent heat treatment for setting the dye.

By way of example, a form of the invention is described more fully hereinafter as applied to the production of randomly coloured or variegated yarn.

In the prior production of randomly coloured yarn a well known technique has been to knit a tubular sock of yarn, pad the sock, that is to say pass it through a pair of resilient rolls extending horizontally with a pool of liquid dye stuff in the nip of the rolls, then pass the sock through a printing machine while it is held extended during which process stripes of different coloured dye are applied to the sock, setting the dye by steaming or otherwise heating the printed sock and finally unravelling the sock to produce a multi-coloured yarn.

However, according to the invention the process is simplified by the elimination of the initial step of preparing a sock, printing that sock, heating the sock to set the dye and unravelling the sock.

The form of the invention now being described includes apparatus for the production of variegated yarns comprising a battery of yarn holders, drive means to draw a plurality of yarns from said battery and to pass them through the remainder of the apparatus, guide means to bring the individual yarns from the battery together to form a web of yarns lying side by side, at least one dye applicator to intermittently apply liquid dye to the web, dye heating means to heat the dye before supplying it to the applicator, said heating means and applicator being such that the dye is applied to the web at or near boiling point and pick-up means able to receive and store the individual yarns from the washed web.

BRIEF DESCRIPTION OF THE DRAWINGS

By way of example, a presently preferred embodiment of the above-described form of the invention is described in detail hereinafter with reference to the accompanying drawings.

DESCRIPTION OF PREFERRED EMBODIMENTS

Figure 1:
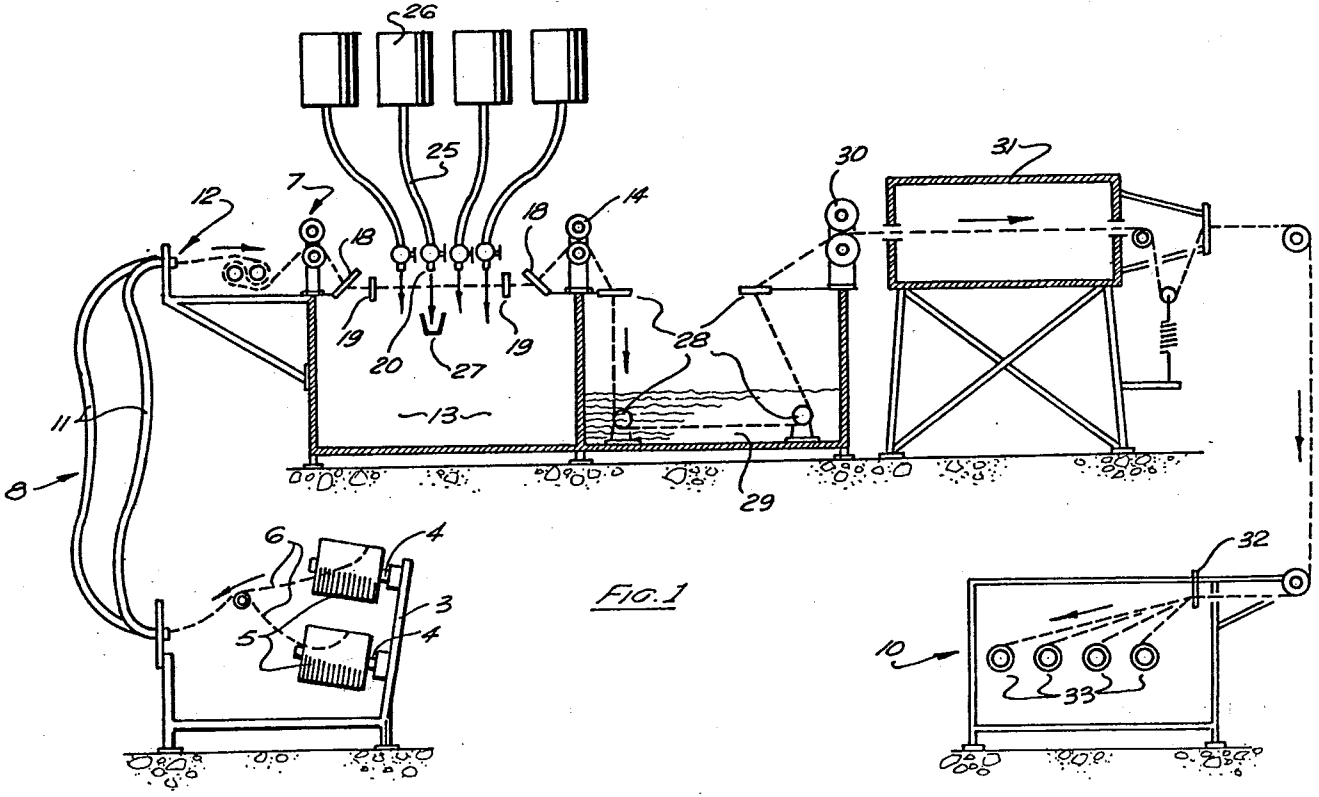
FIG. 1 is a diagrammatic side elevation of a dyeing mechanism.
Figure 2:
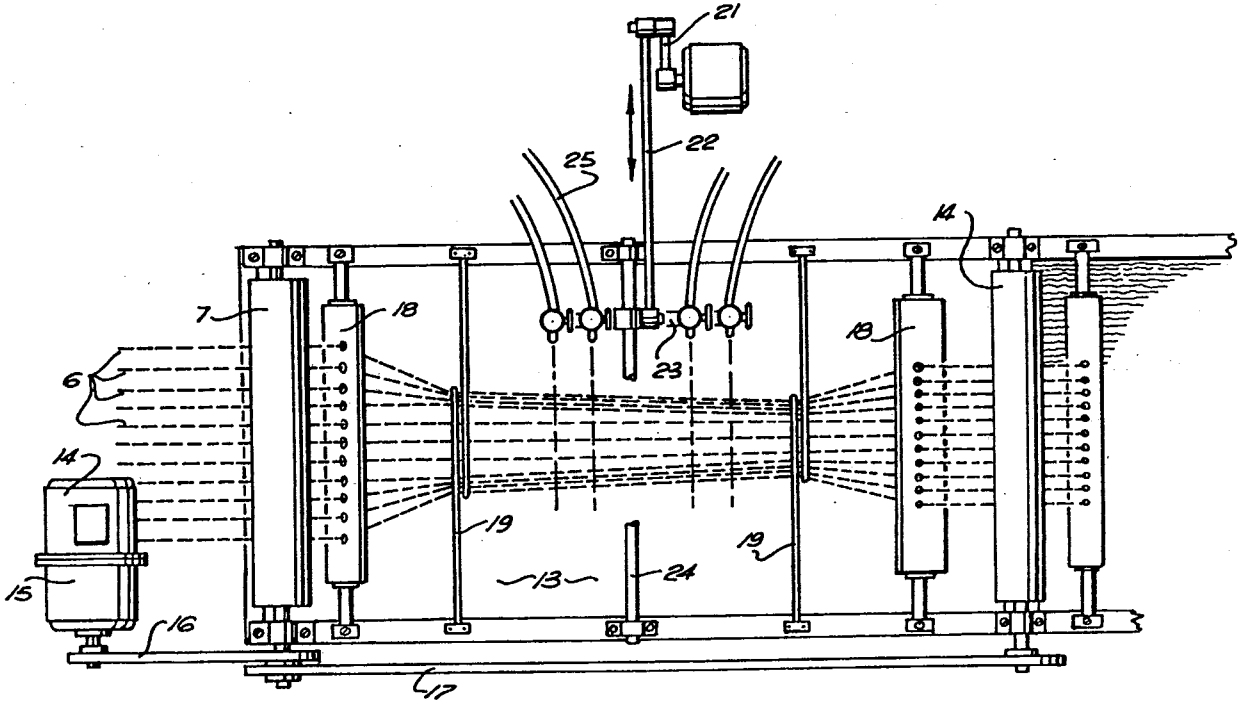
FIG. 2 is a diagrammatic plan view of the dye application station of the mechanism of FIG. 1.

In the illustrated embodiment of the invention the battery of yarn holders comprise a frame 3 having a plurality of rows of projecting cantilever axles 4 each able to accept a conventional "cone" 5 of untreated yarn from each of which a yarn 6 may be drawn.

The drive means to draw the yarns 6 from the battery and pass that through the remainder of the apparatus comprise several sets of power-driven drive rolls positioned at strategic places within the apparatus, as described in more detail below.

The first pair 7 of such rolls is positioned immediately downstream—with reference to the direction of yarn travel through the apparatus—of guide means 8 so that the first pair 7 of drive rolls grips and moves the newly formed web of yarn 6 as it leaves the guide means 8. It and the subsequently met pairs of drive rolls ensure that the yarns 6 comprising the web remain together as a web until they are deliberately separated by conventional pick-up means 10 at the downstream end of the apparatus.

The guide means 8 of the example of the invention now being described comprises a plurality of pliable tubes 11 through each of which is threaded a plurality, for example four to six yarns 6 from a closely located group of cones 5 in the battery. The tubes 11 converge and terminate with their outlet ends 12 disposed side by side in a planar conformation so that the yarns 6 issuing from the respective tubes do so as a web of closely spaced yarns.

That web extends from the first pair 7 of drive rolls more or less horizontally and without other support across the mouth of an open-topped tank 13 into the nip of a second pair 14 of drive rolls. All of the drive rolls are preferably driven by a motor 14 combined with an infinitely variable drive transmission device 15 such that the driving speeds of the drive rolls can be carefully set. The first pair of rolls 7 are driven by a drive transmission belt 16 and the first and second set of drive rolls are chain connected together by endless chain 17 so that the web travelling from one to the other is under very little tension.

In use, at least one dye applicator of four applications in this embodiment applies dye intermittently to the web as it travels from the first to the second set of drive rolls.

The web of yarns 6 may be concentrated under the applicators if desired by means, for example, of perforate guides 18 and wire loop guides 19. The, or each such applicator, may comprise one or a bank of downwardly directed nozzles 20 reciprocating to and fro above the web from one side to the other. Such nozzles may, for example, be caused to reciprocate by a conventional power-driven eccentric or crank 21 connected by a connecting rod 22 to a saddle 23 carrying the nozzles 20 mounted for to and fro sliding motion on an appropriate guide 24 extending transversely of the web.

The nozzles 20 may be connected by relatively short pliable tubes 25 to vats 26 fed from the output of a dye pump fed directly from a steam-heated tank of dye-stuff so that the dye emerging from the nozzle 20 is very close to the temperature of the boiling dye in the tank. As the nozzles travel to and fro they apply strips of colour to the web, such strips being spaced apart in the direction of web travel. The surplus dye-stuff is caught in the tank below the web or in a return gutter 27 for return to the heated vats.

If desired, more than one colour may be applied at this time by utilising more than one applicator each with its own dye supply and removal system.

In addition, if desired, the web leaving the second set of drive rolls 14 may be directed by stationary guide elements 28 into and thence out of a pool of dye-stuff 29 in a heated bath so as to apply a body colour to that part of the yarn left undyed by the applicator or applicators. The dyed web may then be caused in a similar manner to enter and thence leave a dye washing bath and upon emerging from that bath may pass through the nip of a pair of squeegee rolls which to some extent spread the dye, dry the yarn in the web and also function as a third set of drive rolls.

Alternatively, as shown, the dyed yarn may leave the pool 29 by way of squeegee rolls 30 and pass into an electric dryer 31 and then to a conventional take up device 10 wherein the yarns are separated by their passage through guiding eyes 32 and are taken up by a conventional reeling device onto a plurality of reels 33.

According to another embodiment (not illustrated in the drawings) intermittent application of the dye to the web is achieved by provision of a valve, upstream from nozzle 20 which is repetitively opened and closed, thereby interrupting the falling stream of liquid dyestuff to achieve varigated dyeing of the yarns.

For preference, in the latter embodiment the valve is an automatically controlled valve, for example a solenoid valve and is electrically controlled by a circuit to repetitively open and close for predetermined durations. More than one applicator each with its own dye supply and solenoid valve may be used. In that event the arrangement of nozzles and the synchronization of solenoid valve operation may be such as to enable multicoloured dyeing. The use of valve means has the advantage that the intermittent application of the dye can be achieved without need to reciprocate the nozzles.

The claims defining the invention are as follows:

1. Apparatus for dyeing a plurality of yarns comprising:

a battery of yarn holders;

a plurality of pliable tubes for guiding passage of said yarns from said battery to outlet ends of said tubes, said outlet ends of said tubes forming a planar array;

means for drawing a plurality of yarns from said battery through each of said tubes and longitudinally through the remainder of said apparatus at a desired rate of movement, said plurality of yarns forming a web of yarns lying side by side at said outlet ends of said tubes and extending through a portion of the remainder of said apparatus;

at least one nozzle reciprocating transversely of the web of yarns for intermittently applying liquid dye to the longitudinally moving web of yarns at or near the boiling temperature of the liquid dye;

means for feeding liquid dye to said nozzle at a temperature at or near the boiling point of the dye; and means for receiving the washed web directly from said nozzle after application of the liquid dye without additional heating of the yarns and for storing of the individual yarns forming the web.

2. Apparatus for dyeing a yarn comprising:

at least one yarn holder;

drive means for drawing a yarn from said yarn holder and for passing said yarn through the remainder of the apparatus;

means for guiding the individual yarn drawn from the holder by said drive means;

at least one dye applicator for intermittently applying liquid dye to the yarn at a temperature at or near the boiling point of the dye;

dye heating means for heating the dye to a temperature at or near its boiling point before supplying the dye to the applicator; and pickup means able to receive and store the washed yarn.

3. Apparatus according to claim 2 wherein said applicator comprises:

a reciprocating nozzle;

means for feeding boiling dyestuff to the nozzle; and means for returning unused surplus dyestuff to the nozzle following reheating of the surplus dyestuff to its boiling point.

4. Apparatus according to claim 2 or 3 further comprising:

a heated tank adapted to hold a pool of boiling dyestuff; and means for directing the yarn into and out of said pool after the yarn emerges from said applicator.

5. Apparatus for dyeing a plurality of yarns comprising:

a battery of yarn holders;

drive means for drawing a plurlity of yarns from said battery and for passing the plurality of yarns through the remainder of the apparatus;

guide means for bringing the individual yarns from the battery together to form a web of yarns lying side by side;

at least one dye applicator for intermittently applying liquid dye to the web at a temperature at or near the boiling point of the dye;

dye heating means for heating the dye to a temperature at or near its boiling point before applying it to the applicator; and pickup means able to receive and store the individual yarns from the washed web.

6. Apparatus according to claim 5 wherein said guide means comprise a plurality of pliable tubes through which respective yarns extend and which have their outlet ends disposed in a planar array.

7. Apparatus according to claim 5 or claim 6 wherein said applicator comprises:

a reciprocating nozzle;

means for feeding boiling dyestuff of the nozzle; and means for returning unused surplus dyestuff to the nozzle following reheating of the surplus dyestuff to its boiling point.

8. Apparatus according to claim 5 or 6 further comprising:

a heated tank adapted to hold a pool of boiling dyestuff; and means for directing the yarn into and out of said pool after it emerges from said applicator.

* * * * *